US009836968B2

(12) United States Patent
Poechmueller et al.

(10) Patent No.: US 9,836,968 B2
(45) Date of Patent: Dec. 5, 2017

(54) METHOD AND APPARATUS TO WARN OF A VEHICLE MOVING IN THE WRONG DIRECTION OF TRAVEL

(71) Applicant: Robert Bosch GmbH, Stuttgart (DE)

(72) Inventors: Werner Poechmueller, Hildesheim (DE); Andreas Offenhaeuser, Marbach Am Neckar (DE)

(73) Assignee: ROBERT BOSCH GMBH, Stuttgart (DE)

( * ) Notice: Subject to any disclaimer, the term of this patent is extended or adjusted under 35 U.S.C. 154(b) by 0 days.

(21) Appl. No.: 15/205,100

(22) Filed: Jul. 8, 2016

(65) Prior Publication Data

US 2017/0018178 A1 Jan. 19, 2017

(30) Foreign Application Priority Data

Jul. 17, 2015 (DE) ..... 10 2015 213 521

(51) Int. Cl.
*G08G 1/056* (2006.01)
*G08G 1/0962* (2006.01)
*G08G 1/09* (2006.01)

(52) U.S. Cl.
CPC ..... *G08G 1/056* (2013.01); *G08G 1/09623* (2013.01); *G08G 1/091* (2013.01)

(58) Field of Classification Search
None
See application file for complete search history.

(56) References Cited

U.S. PATENT DOCUMENTS

2013/0044009 A1* 2/2013 Tagawa ..... G08G 1/075 340/995.28
2015/0130643 A1* 5/2015 Nagy ..... G08G 1/056 340/935
2015/0145699 A1* 5/2015 Mielenz ..... G08G 1/056 340/935
2016/0217687 A1* 7/2016 Rous ..... G08G 1/056
2016/0217688 A1* 7/2016 Jeschke ..... G06K 9/00798
2016/0343253 A1* 11/2016 Imai ..... G06K 9/00818
2017/0003134 A1* 1/2017 Kim ..... B60R 1/00

* cited by examiner

*Primary Examiner* — Krishnan Ramesh
(74) *Attorney, Agent, or Firm* — Norton Rose Fulbright US LLP; Gerard Messina

(57) ABSTRACT

A method to warn of a vehicle moving in the wrong direction of travel, wherein in a provision step, a third-party warning message is provided for other road users when at least one wrong-way-driver signal signals wrong-way travel of the wrongly moving vehicle sensed using a wrong-way-driver sensing method, and in an output step, a self-warning message is output for a driver of the vehicle moving in the wrong direction of travel when the wrong-way-driver signal signals the sensed wrong-way travel and at least one further wrong-way-driver signal signals the wrong-way travel of the wrongly moving vehicle sensed using a further wrong-way-driver sensing method, the further wrong-way-driver sensing method differing from the wrong-way-driver sensing method.

11 Claims, 2 Drawing Sheets

METHOD AND APPARATUS TO WARN OF A VEHICLE MOVING IN THE WRONG DIRECTION OF TRAVEL

CROSS REFERENCE

The present application claims the benefit under 35 U.S.C. §119 of German Patent Application No. DE 102015213521.7 filed on Jul. 17, 2015, which is expressly incorporated herein by reference in its entirety.

BACKGROUND INFORMATION

In case of an accident, wrong-way drivers, also called ghost drivers, cause deaths, injuries and considerable material damage. Detection solely on the basis of the navigation system via a highway class and a highway direction is too late for most cases, that is, the wrong-way driver is already on the wrong roadway with high traveling speed and great probability of a collision.

Over half the instances of wrong-way travel begin at federal-highway interchanges. Especially during wrong-way travel on freeways, accidents occur at high collision speed, often accompanied by injuries resulting in death.

SUMMARY

Against this background, a method is provided to warn of a vehicle moving in the wrong direction of travel, an apparatus that uses this method, as well as, finally, a corresponding computer program.

Owing to a warning message about an oncoming vehicle, thus, a vehicle moving in the wrong direction of travel, a driver of a vehicle traveling according to regulations is able to adjust his manner of driving to achieve the least possible endangerment for himself and others. However, no immediate reactions are necessary in doing so. The latent endangerment of the driver is reduced merely by driving in the right traffic lane and by heightened alertness.

On the other hand, however, if a driver is warned of his own wrong-way travel, it is necessary that he act as quickly as possible, since he represents the hazard for the normally moving traffic.

If a driver driving according to regulations is warned mistakenly of his own wrong-way travel, he may then overreact, which first makes him an actual wrong-way driver if, for example, based on the warning message, he turns around and then drives counter to the direction of traffic.

Since methods for detecting wrong-way travel exhibit uncertainty in the detection, it is advantageous if a self-warning is supported by at least two different detection methods. False messages warning of a driver's own wrong-way travel may therefore be suppressed.

A method is introduced to warn of a vehicle moving in the wrong direction of travel, the method having the following steps:

Provision of a third-party warning for other road users when at least one wrong-way-driver signal signals wrong-way travel of the wrongly moving vehicle sensed using a wrong-way-driver sensing method; and Output of a self-warning message for a driver of the vehicle moving in the wrong direction of travel when the wrong-way-driver signal signals the sensed wrong-way travel and at least one further wrong-way-driver signal signals the wrong-way travel of the wrongly moving vehicle sensed using a further wrong-way-driver sensing method, the further wrong-way-driver sensing method differing from the wrong-way-driver sensing method.

A wrong-way driver or ghost driver may be understood to be a vehicle moving against the traffic. A third-party warning message may be referred to as third-party warning. For example, the third-party warning message may contain position information about a sensed position of the wrong-way driver, direction information about a sensed direction of travel of the wrong-way driver, distance information about an ascertained distance from the wrong-way driver and/or general behavior information. A wrong-way-driver signal may represent a result of a wrong-way-driver sensing method. A wrong-way-driver sensing method may represent a detection method for detecting wrong-way travel of a vehicle. For instance, a self warning may contain a prompt for an action adapted subject to the situation.

The method may include a step of executing at least one of the wrong-way-driver sensing methods using an electronic device located in the vehicle moving against the traffic. In this way, for example, it is possible to fall back on an inertia sensor system or a position-determining device of the wrongly moving vehicle.

The method may further have a step of executing at least one of the wrong-way-driver sensing methods using an infrastructure device. In this way, it is also possible to detect the wrong-way travel of a vehicle which has no suitable sensor system or does not communicate relevant data to the outside.

The wrong-way-driver sensing method may be designed to determine the wrong-way-driver signal using a first input variable. Correspondingly, the further wrong-way-driver sensing method may be designed to determine the further wrong-way-driver signal using a second input variable differing from the first input variable. In this way, for instance, the further wrong-way-driver sensing method may be utilized to check the plausibility of the wrong-way-driver signal provided by the wrong-way-driver sensing method.

For example, one of the wrong-way-driver sensing methods may be designed to determine the wrong-way-driver signal using a traffic-sign recognition, and the other of the wrong-way-driver sensing methods may be designed to determine the further wrong-way-driver signal using a trajectory of a movement of the wrongly traveling vehicle and a digital map, e.g., by comparing the trajectory to a traffic route entered in the digital map. If both methods suggest a wrong-way travel, it may then be assumed with great certainty that it actually is a case of wrong-way travel.

The wrong-way-driver sensing method may also be designed to determine the wrong-way-driver signal using a trajectory of a movement of the wrongly traveling vehicle and a digital map, and the further wrong-way-driver sensing method may be designed to determine the wrong-way-driver signal using the trajectory of the movement of the wrongly traveling vehicle and a further digital map. For instance, the further map may have a higher degree of detail than the other map.

In the provision step, the third-party warning message may be provided as a function of a comparison of a confidence value represented by the wrong-way-driver signal, and a threshold value assigned to the wrong-way-driver sensing method. For instance, the third-party warning message may be provided when the wrong-way-driver signal represents a confidence value that is greater than a threshold value assigned to the wrong-way-driver sensing method. A confidence value may represent a detection probability of a detection operation. For example, the confidence value may be derived from a quality of the input variables. Consequently, it is possible to prevent a wrong-way-driver signal triggered because of a signal noise, for example, from leading to the third-party warning message.

In the output step, the self-warning message may be output as a function of a comparison of a further confidence value represented by the further wrong-way-driver signal, and a further threshold value assigned to the further wrong-way-driver sensing method. For instance, the self-warning message may be output when the at least two wrong-way-driver signals each represent a confidence value greater than a threshold value assigned to the respective wrong-way-driver sensing method. Cases of mistakenly recognized wrong-way travel may be suppressed by the use of two threshold values.

The third-party warning message may be made available via a wireless communication method. By way of example, the third-party warning message may be provided via mobile radio communication. A well-developed infrastructure may thereby be used to warn of wrong-way drivers.

The method may have a step of executing at least one of the wrong-way-driver sensing methods. In this case, the wrong-way-driver signal may be generated when the wrong-way travel of the vehicle is detected. A short reaction time is able to be achieved by the direct execution of at least one wrong-way-driver sensing method.

In the execution step, at least one of the wrong-way-driver sensing methods may be carried out in an electronic device in the vehicle. For example, the electronic device may be a mobile device. The wrong-way driver may thereby be sensed directly in the vehicle.

For example, this method may be implemented in software or hardware or in a mixed form of software and hardware, e.g., in a control unit.

The approach presented here also provides an apparatus which is designed to carry out, control or implement the steps of a variant of a method presented here in suitable devices. The object of the present invention may be achieved quickly and efficiently by this embodiment variant of the invention in the form of an apparatus, as well.

An apparatus in the present case may be understood to be an electrical device or a combination of several electrical devices which process sensor signals and output control signals and/or data signals as a function thereof. The apparatus may have an interface which may be implemented in hardware and/or software. In the case of a hardware implementation, the interfaces may be part of what is termed a system ASIC, for example, that includes a wide variety of functions of the apparatus. However, it is also possible for the interfaces to be separate, integrated circuits or to be made up at least partially of discrete components. In the case of a software implementation, the interfaces may be software modules which, for example, are available in a microcontroller in addition to other software modules.

Also of advantage is a computer-program product or computer program having program code that may be stored on a machine-readable carrier or storage medium such as a semiconductor memory, a hard-disk storage or an optical memory, and is used to carry out, implement and/or control the steps of the method according to one of the previously described specific embodiments, especially when the program product or program is executed on a computer or a device.

Exemplary embodiments of the present invention are shown in the figures and are explained in greater detail below.

DETAILED DESCRIPTION OF EXAMPLE EMBODIMENTS

Figure 1:
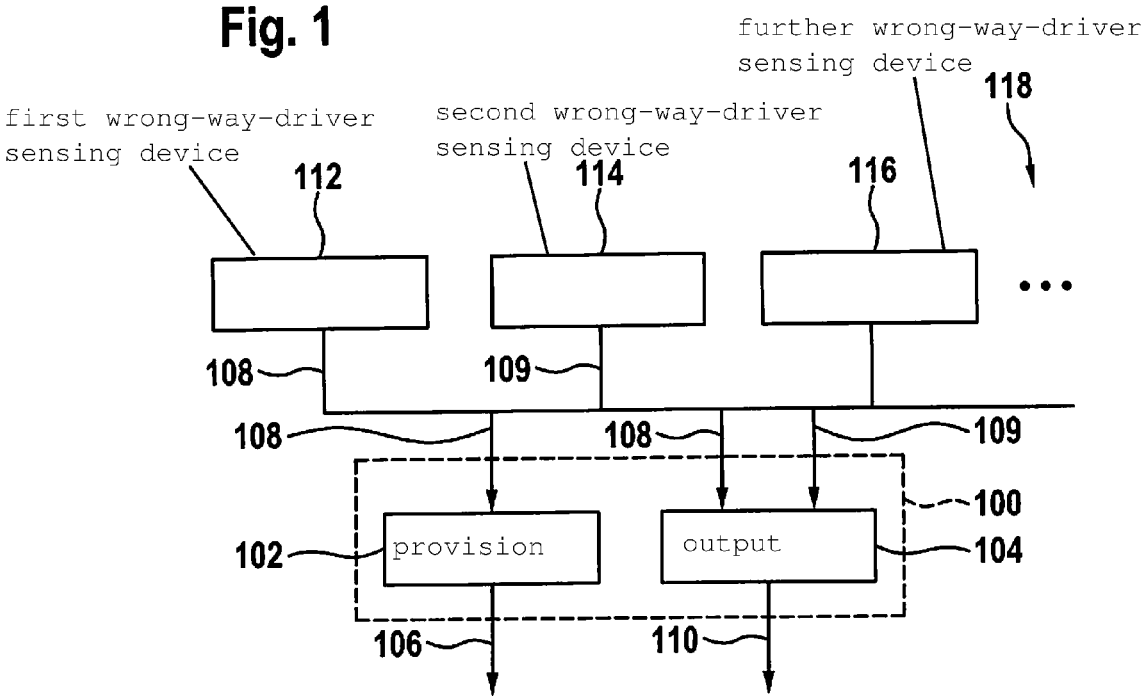
FIG. 1 shows a block diagram of an apparatus to warn of a vehicle moving in the wrong direction of travel according to one exemplary embodiment.

In the following description of preferred exemplary embodiments of the present invention, the same or similar reference numerals are used for the similarly functioning elements shown in the various figures, a repeated description of these elements being omitted.

FIG. 1 shows a block diagram of an apparatus 100 to warn other road users of a vehicle moving against the traffic according to one exemplary embodiment. The apparatus has one device 102 for the provision and one device 104 for the output. Device 102 for the provision is designed to provide a third-party warning message 106 for other road users when at least one wrong-way-driver signal 108 signaling the vehicle moving in the wrong direction of travel is read in. Device 104 for the output is designed to output a self-warning message 110 for a driver of the wrongly moving vehicle when wrong-way-driver signal 108 signals the detected wrong-way travel, and in addition, at least one further wrong-way-driver signal 109 signaling the wrongly moving vehicle is read in.

The apparatus is coupled to at least one first wrong-way-driver sensing device 112 and a second wrong-way-driver sensing device 114. First wrong-way-driver sensing device 112 is designed to execute a first wrong-way-driver sensing method. By executing the first wrong-way-driver sensing method, the vehicle moving against the traffic may be detected and wrong-way-driver signal 108 signaling the wrong-way travel may be provided. Second wrong-way-driver sensing device 114 is designed to execute a second wrong-way-driver sensing method. By executing the second wrong-way-driver sensing method, the vehicle moving against the traffic may likewise be detected and further wrong-way-driver signal 109 signaling the wrong-way travel may be provided. The first and the second wrong-way-driver sensing methods differ from each other, so that the vehicle moving in the wrong direction of travel may be recognized in two different ways. According to one exemplary embodiment, the apparatus is coupled to further wrong-way-driver sensing devices 116, 118 for executing further wrong-way-driver sensing methods. In this case, the wrong-way-driver sensing methods are based on different sensing principles and, at least in part, different input variables. According to one exemplary embodiment, the wrong-way-driver sensing methods are redundant relative to each other.

In one exemplary embodiment, apparatus 100 is disposed in an infrastructure device. Alternatively, apparatus 100 may also be located in the wrongly traveling vehicle or in another vehicle. Wrong-way-driver sensing devices 112, 114, 116, 118 may likewise be disposed in one or more infrastructure devices or in the wrongly moving vehicle. Alternatively, a portion of wrong-way-driver sensing devices 112, 114, 116, 118 may be disposed in at least one infrastructure device, and a further portion of wrong-way-driver sensing devices 112, 114, 116, 118 may be located in the wrongly moving vehicle or in another vehicle. According to one exemplary embodiment, apparatus 100 and wrong-way-driver sensing devices 112, 114, 116, 118 are part of a system 100 to warn other road users of a vehicle moving against the traffic.

The approach described makes it possible to detect a wrong-way driver with a differentiation of warning strategy depending on confidence levels of independent detection methods.

Both a warning of another ghost driver, as well as a warning that the driver himself is a wrong-way driver, represents a strong psychological message. The warning of another ghost driver may be denoted as third-party warning 106. The warning that the driver himself is the wrong-way driver may be denoted as self warning 110. In the case of both warnings, there is the risk of a "knee-jerk reaction" by the warned driver in certain situations. Therefore, the warning strategy and its reliability are extremely important.

Various methods exist for detecting a wrong-way driver which, for example, may be carried out using wrong-way-driver sensing devices 112, 114, 116, 118. For instance, the passing of a "no entry" sign may be detected by using a video sensor system. Likewise, a digital map may be used in conjunction with a route navigation to detect a wrong direction of travel on a highway section that is open to traffic only in one direction. In addition, a wrong-way driver may be detected by wireless methods that are realized with the aid of infrastructure such as bars in or at the edge of the roadway.

The approach described permits a suitable warning strategy in case a wrong-way travel is detected. In this context, a differentiation is made between a warning of a third-party wrong-way driver, a third-party warning 106 and a self warning 110, where the driver is driving in the wrong direction of travel.

The detection methods which are carried out, for example, using wrong-way-driver sensing devices 112, 114, 116, 118, exhibit different quality of recognition and therefore are sometimes suitable only for the practical application of one of the warning strategies, thus, for third-party warning 106 or for self warning 110.

For example, detection of the passing of no-entry signs using a video camera may be used as detection method. Likewise, a wrong-way travel may be derived from the traveled trajectory in comparison to a digital map of the highway system with attributes of the direction of traffic in force. Wrong-way drivers may also be detected by comparing the position and direction of travel of a vehicle to setpoint data, the setpoint data being derivable from digital map material or the setpoint data being able to be generated from the history of other road users.

These methods have different advantages and disadvantages such as different detection speed, different complexity of the algorithm, a different range of the necessary sensor system and a different false-triggering rate. In this context, it is possible to differentiate between a false positive rate (FP rate) and a false negative rate (FN rate).

The detection of the passing of no-entry signs exhibits high complexity accompanied by outstanding detection quality. The derivation of the wrong-way travel from the trajectory traveled in comparison to a digital map of the highway system exhibits low complexity, accompanied by high detection quality. The detection of a wrong-way driver by comparing the position and direction of travel of a vehicle to setpoint data from digital map material exhibits below-average complexity accompanied by low detection quality. The detection of a wrong-way driver by comparing the position and direction of travel of a vehicle to setpoint data generated from the history of other road users exhibits above-average complexity accompanied by below-average detection quality.

In this context, a falsely triggered self warning 110 is substantially more critical than a falsely triggered third-party warning 106, since self warning 110 has a very strong psychological effect for an untrained driver, and in the worst case, even unintentionally makes him a wrong-way driver if the warning is triggered at an inappropriate moment.

The reason is that in the case of a self warning 110, the driver is "compelled" to make an immediate decision about his further driving strategy. In this case, the correct decision in response to the driver's own wrong-way travel is to drive at the edge of the roadway, to telephone the police and to ask for help.

A wrong decision would be to turn the vehicle around or to drive in reverse.

Should the warning be incorrect as in the case of a false positive decision of the wrong-way driver detection, in the event the driver reacts incorrectly, he himself could indeed become a "wrong-way driver."

A "third-party warning" 106, thus, the warning of a driver about another wrong-way driver triggers substantially less mental stress. First of all, to a certain degree, drivers are already accustomed today to such warnings of other ghost drivers via TMC (traffic message channel) messages from the radio. Secondly, in the case of this type of warning, there is sufficient time for the driver to make his decision for a suitable driving strategy. For example, he may reduce his speed, change to the right traffic lane and observe the upcoming traffic over a wide area. There is only a slight risk for a poor "panic reaction."

The approach presented here maximizes the use of the wrong-way-driver detection to warn other drivers, and minimizes the risk that a driver will himself become a wrong-way-driver owing to a false self warning 110.

In the process, confidences in the individual classification methods and their skillful coupling are used. Each algorithm is assigned a maximum confidence that is derivable directly from empirical values or the detection principle. During the detection, for each type of detection, an individual degree of confidence increases up to the maximum value specific to the algorithm.

In one exemplary embodiment, the very simple approach of detecting wrong-way drivers by comparing the position and direction of travel of the vehicle to setpoint data derived from digital map material and detection of the passing of no-entry signs by a video camera is used for the third-party warning. To trigger self warning 110, however, the more complex approach of detecting wrong-way drivers by a comparison of the position and direction of travel of a vehicle to setpoint data generated from the history of other road users coupled with the detection of the passing of no-entry signs by a video camera, as well as a deduction of the wrong-way travel from the trajectory traveled in comparison to a digital map of the highway system with attributes of the direction of traffic in force is used, which results in a substantially lower false-triggering rate.

In a further exemplary embodiment, generally two different methods which are as "orthogonal" as possible are used to detect a ghost driver. If both detection methods take effect simultaneously, a self warning 110 and a third-party warning 106 are triggered. By the combination of orthogonal methods, functions in the vehicle critical with regard to safety may be implemented. However, if only one of the methods takes effect, then only a third-party warning 106 is triggered, but not a self warning 110 of the driver who would turn into the wrong-way driver.

Orthogonal methods may be realized by various system embodiments. For example, the at least two different detection methods may both be carried out on one electronic device in the vehicle. A smart phone, a connectivity control unit (telematics device, in special form an eCall box), a head unit (infotainment system), a navigation system or a central vehicle gateway may be used as electronic device.

As soon as the detection exists for a "third-party warning" 106, it may be sent to other vehicles in the proximity either in direct form by vehicle-to-vehicle communication, e.g., via pWLAN or via cellular mobile radio communication with the aid of a central server.

When using a telematics system having a central server, one of the at least two methods for detecting wrong-way travel may be carried out on an electronic device in the vehicle, however at least one further detection method is carried out on the server.

Specifically, a traffic-sign recognition of "no entry" signs may be carried out locally in the vehicle. At the same time, the vehicle sends its position to the central server with great frequency. The central server compares position and direction of travel of the vehicle to the data of a digital map to likewise determine whether a case of wrong-way travel exists.

If only the detection of one of the several detection methods exists, the central server then triggers only a third-party warning 106. If several or all detection methods take effect, the central server additionally transmits a self warning 110 to the vehicle moving in the wrong direction of travel.

Using a central server, several or all of the at least two different detection methods may also be carried out on the central server. For example, the vehicles may constantly report their positions to the central server. It tracks the vehicles and, by comparison to a first digital map, detects whether or not wrong-way travel exists. To increase detection reliability, the server may also compare the vehicle position to a second digital map generated independently of the first map. The second map may also be a "learned" map, in which by monitoring many vehicles, the server has determined in what direction a multitude of vehicles is usually moving. If only one detection method takes effect, only a third-party warning 106 is triggered; if both detection methods take effect, in addition, a self warning 110 is transmitted to the causative vehicle.

In one exemplary embodiment, in addition to actual detection result 108 "wrong-way driver present" or "wrong-way driver not present", the at least two detection methods supply a confidence value. A further decision component uses the confidence value in order, as a function of the detection result and the confidence value, to make the decision to trigger only a third-party warning 106 or a third-party warning 106 and self warning 110. In particular, a third-party warning 106 is triggered only when one of the at least two confidence values exceeds a predefined threshold value. An additional self warning 110 is triggered only when at least two or all of the confidence values exceed one or more different threshold values. Here, as well, the additional decision component may be either on an electronic device in the vehicle or on the central server.

Figure 2:
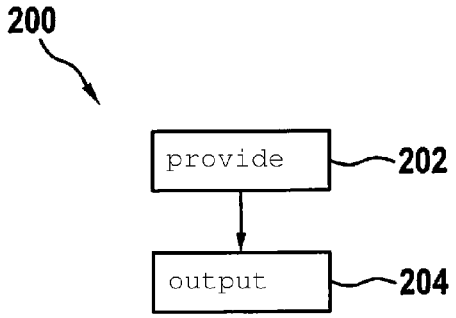
FIG. 2 shows a flowchart of a method to warn of a vehicle moving in the wrong direction of travel according to one exemplary embodiment.

FIG. 2 shows a flowchart of a method 200 to warn of a vehicle moving against the traffic according to one exemplary embodiment. Method 200 has a provision step 202 and an output step 204. In provision step 202, a third-party warning message is provided for other road users if at least one wrong-way-driver signal is read in. In this context, the wrong-way-driver signal signals wrong-way travel of the vehicle sensed using a wrong-way-driver sensing method. In output step 204, a self-warning message is output for a driver of the vehicle if at least two wrong-way-driver signals are read in. In this instance, the wrong-way-driver signals signal wrong-way travel of the vehicle sensed using two different wrong-way-driver sensing methods. According to one exemplary embodiment, one of the wrong-way-driver signals considered in output step 204 is the wrong-way-driver signal considered in provision step 202. Alternatively, the wrong-way-driver signals considered in step 204 are wrong-way-driver signals differing from the wrong-way-driver signal considered in provision step 202.

According to one exemplary embodiment, method 200 represents a method for detecting wrong-way drivers and for the subsequent triggering of a warning strategy for the "self warning" of the vehicle moving in the wrong direction of travel and for the "third-party warning" of other vehicles in the proximity of the wrong-way driver. Method 200 is characterized in that at least two different detection methods are carried out to detect the wrong-way driver. In response to the triggering of only one detection method, a "third-party warning" 202 is implemented exclusively. In response to the additional triggering of at least one second detection method, in addition, a self warning 204 is triggered.

All of the at least two different detection methods may be executed on one electronic device in the vehicle.

At least one of the at least two different detection methods may be carried out on an electronic device in the vehicle, while at least one further detection method is executed on a central server.

Several or all of the at least two different detection methods may be executed on one central server.

The detection method executed in the vehicle may be executed on an electronic device that is carried along, such as a smart phone, a connectivity control unit, especially an eCall box, a head unit or an infotainment system, a navigation system or a central vehicle gateway.

The one of the at least two detection methods may be based on a traffic-sign recognition. A further detection method may be based on the comparison of the vehicle movement to a digital map.

The one of the at least two detection methods may be based on a comparison of the vehicle movement to a first digital map. A further detection method may be based on a comparison of the vehicle movement to a second digital map.

The at least two detection methods may generate confidence values. A decision component may compare the confidence values to threshold values, and based on the threshold-value comparison, decide whether no warning is output, whether a third-party warning is output, or whether a combined self warning and third-party warning is output.

Figure 3:
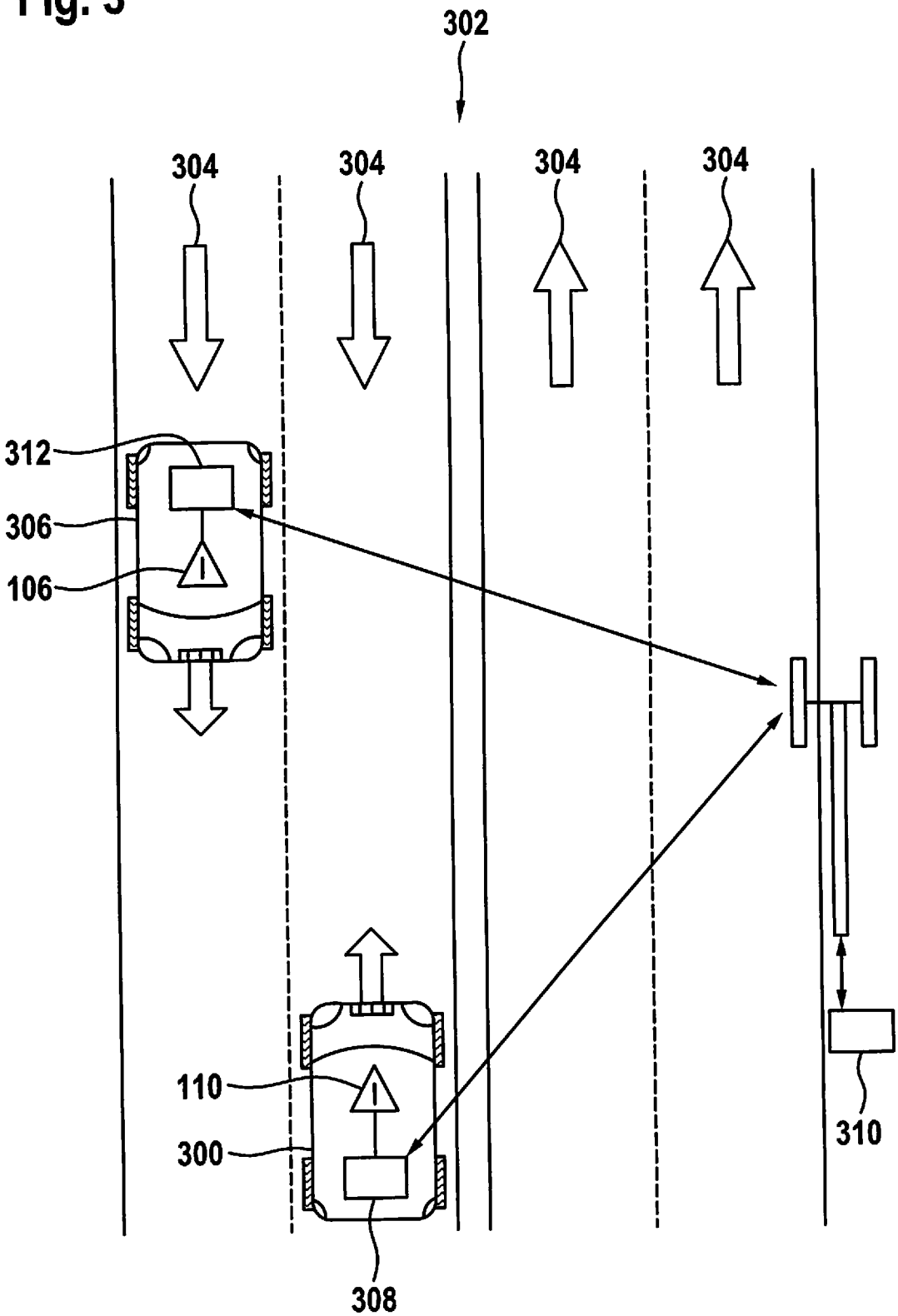
FIG. 3 shows a representation of a vehicle moving in the wrong direction of travel during a warning according to one exemplary embodiment.

FIG. 3 shows a representation of a vehicle 300 moving in the wrong direction of travel during a warning according to one exemplary embodiment. Wrongly moving vehicle 300 may be referred to as wrong-way driver 300 or ghost driver 300, and is traveling on a multilane highway 302 with separate traffic lanes, counter to direction of traffic 304 in force. A normally moving vehicle 306 is approaching vehicle 300. Normally moving vehicle 306 may be referred to as other road user 306 or proper driver 306.

In one exemplary embodiment, a method for warning according to one exemplary embodiment as described, e.g., in FIG. 2, is carried out on a warning device 308 in wrongly moving vehicle 300. Warning device 308 may be referred to as apparatus for warning.

Warning device 308 may likewise be denoted as electronic device 308. For example, warning device 308 may be a smart phone 308, a navigation system 308 or a system 308 permanently installed in the vehicle and having a man-machine interface.

As soon as a wrong-way-driver signal is read in, a third-party warning message 106 is dispatched via an infrastructure device 310 and displayed on a further warning device 312 in correctly moving vehicle 306. Infrastructure device 310 may be denoted as server 310. Further warning device 312 may correspond essentially to an exemplary embodiment of warning device 308.

The wrong-way-driver signal may be provided by a detection device in vehicle 300. The detection device may be part of warning device 308. The wrong-way-driver signal may likewise be provided by infrastructure device 310.

If a further wrong-way-driver signal is read in, a self-warning message 110 is output by warning device 308 in vehicle 300. In this case, the further wrong-way-driver signal may be provided by the detection device in vehicle 300 or a further detection device in vehicle 300. The further detection device may be part of warning device 308, as well. The further wrong-way-driver signal may likewise be provided by infrastructure device 310.

In one exemplary embodiment, the method for warning according to one exemplary embodiment is carried out on infrastructure device 310. As soon as the wrong-way-driver signal is read in, third-party warning message 106 is transmitted to further warning device 312 and made available. If the further wrong-way-driver signal is read in, self-warning message 110 is transmitted to warning device 308 and made available.

In this context, the wrong-way-driver signal and/or the further wrong-way-driver signal may be provided by warning device 308. The wrong-way-driver signal and/or the further wrong-way-driver signal may likewise be provided by at least one detection device (not shown) of infrastructure device 310.

If an exemplary embodiment includes an "and/or" link between a first feature and a second feature, this is to be read in such a way that the exemplary embodiment according to one embodiment has both the first feature and the second feature, and according to a further embodiment, has either only the first feature or only the second feature.

What is claimed is:

1. A method to warn of a vehicle moving in a wrong direction of travel, the method comprising:

providing a third-party warning message for other road users when at least one wrong-way-driver signal signals wrong-way travel of the wrongly moving vehicle sensed using a wrong-way-driver sensing method; and outputting a self-warning message for a driver of the vehicle moving in the wrong direction of travel when the wrong-way-driver signal signals the sensed wrong-way travel and at least one further wrong-way-driver signal signals the wrong-way travel of the wrongly moving vehicle sensed using a further wrong-way-driver sensing method, the further wrong-way-driver sensing method differing from the wrong-way-driver sensing method.

2. The method as recited in claim 1, further comprising:

executing at least one of: i) the wrong-way-driver sensing method, and ii) the further wrong-way-driver sensing method, using an electronic device located in the vehicle moving in the wrong direction of travel.

3. The method as recited in claim 1, further comprising:

executing at least one of: i) the wrong-way-driver sensing method, and ii) the further wrong-way driver sensing method, using an infrastructure device.

4. The method as recited in claim 1, wherein the wrong-way-driver sensing method is designed to determine the wrong-way-driver signal using a first input variable, and the further wrong-way-driver sensing method is designed to determine the further wrong-way-driver signal using a second input variable differing from the first input variable.

5. The method as recited in claim 1, wherein at least one of: i) one of the wrong-way-driver sensing method and the further wrong-way-driver sensing method is designed to determine the wrong-way-driver signal using a traffic-sign recognition, and ii) the other of the wrong-way-driver sensing method and the further wrong-way-driver sensing method is designed to determine the further wrong-way-driver signal using a trajectory of a movement of the wrongly moving vehicle, and a digital map.

6. The method as recited in claim 1, wherein the wrong-way-driver sensing method is designed to determine the wrong-way-driver signal using a trajectory of a movement of the wrongly moving vehicle and a digital map, and the further wrong-way-driver sensing method is designed to determine the wrong-way-driver signal using the trajectory of the movement of the wrongly moving vehicle, and a further digital map.

7. The method as recited in claim 1, wherein in the providing step, the third-party warning message is provided as a function of a comparison of a confidence value represented by the wrong-way-driver signal, and a threshold value assigned to the wrong-way-driver sensing method.

8. The method as recited in claim 1, in which in the output step, the self-warning message is output as a function of a comparison of a further confidence value represented by the further wrong-way-driver signal, and a further threshold value assigned to the further wrong-way-driver sensing method.

9. The method as recited in claim 1, wherein in the providing step, the third-party warning message is provided via a wireless communication method.

10. An apparatus, configured to:

provide a third-party warning message for other road users when at least one wrong-way-driver signal signals wrong-way travel of the wrongly moving vehicle sensed using a wrong-way-driver sensing method; and output a self-warning message for a driver of the vehicle moving in the wrong direction of travel when the wrong-way-driver signal signals the sensed wrong-way travel and at least one further wrong-way-driver signal signals the wrong-way travel of the wrongly moving vehicle sensed using a further wrong-way-driver sensing method, the further wrong-way-driver sensing method differing from the wrong-way-driver sensing method.

11. A non-transitory machine-readable storage medium, on which a computer program is stored, the computer program to warn of a vehicle moving in a wrong direction of travel, the computer program, when executed by a processing device, causing the processing device to perform:

providing a third-party warning message for other road users when at least one wrong-way-driver signal signals wrong-way travel of the wrongly moving vehicle sensed using a wrong-way-driver sensing method; and outputting a self-warning message for a driver of the vehicle moving in the wrong direction of travel when the wrong-way-driver signal signals the sensed wrong-way travel and at least one further wrong-way-driver signal signals the wrong-way travel of the wrongly moving vehicle sensed using a further wrong-way-driver sensing method, the further wrong-way-driver sensing method differing from the wrong-way-driver sensing method.

* * * * *